US008291805B1

(12) United States Patent
Quilligan

(10) Patent No.: US 8,291,805 B1
(45) Date of Patent: Oct. 23, 2012

(54) QUICK-ATTACH LOCKING DEVICE FOR A FLASH HIDER

(76) Inventor: Jay J. Quilligan, Buhl, ID (US)

( * ) Notice: Subject to any disclaimer, the term of this patent is extended or adjusted under 35 U.S.C. 154(b) by 111 days.

(21) Appl. No.: 13/045,459

(22) Filed: Mar. 10, 2011

Related U.S. Application Data

(60) Provisional application No. 61/312,516, filed on Mar. 10, 2010.

(51) Int. Cl.
*F41A 21/00* (2006.01)

(52) U.S. Cl. ..... 89/14.2; 42/75.01; 89/14.3; 285/305

(58) Field of Classification Search ..... 89/14.05–16; 42/75.01
See application file for complete search history.

(56) References Cited

U.S. PATENT DOCUMENTS

| | | | | | |
|---|---|---|---|---|---|
| 1,138,465 | A * | 5/1915 | Fegley et al. | 279/82 |
| 1,841,008 | A * | 1/1932 | Burn | 74/502.6 |
| 3,733,577 | A * | 5/1973 | Hammond | 439/357 |
| 3,913,954 | A * | 10/1975 | Klimpl | 285/305 |
| 4,431,218 | A * | 2/1984 | Paul et al. | 285/305 |
| 4,749,192 | A * | 6/1988 | Howeth | 285/86 |
| 4,813,333 | A * | 3/1989 | Garris et al. | 89/14.3 |
| 4,894,156 | A * | 1/1990 | Murken | 210/448 |
| 5,685,102 | A * | 11/1997 | Latka | 42/85 |
| 5,773,746 | A | 6/1998 | Vaden | |
| 6,019,014 | A * | 2/2000 | Jenkins | 74/502.4 |
| 6,026,728 | A * | 2/2000 | Guhring et al. | 89/14.5 |
| 6,450,079 | B1 * | 9/2002 | Bourdin et al. | 89/14.3 |
| 6,948,415 | B2 | 9/2005 | Matthews et al. | |
| 6,973,863 | B1 | 12/2005 | Jones | |
| 7,661,349 | B1 | 2/2010 | Brittingham | |
| 7,676,976 | B2 | 3/2010 | Dueck et al. | |
| 7,677,150 | B2 * | 3/2010 | Dater et al. | 89/14.05 |
| 7,735,406 | B1 * | 6/2010 | Olson | 89/14.3 |
| 7,743,693 | B1 | 6/2010 | Brittingham | |
| 7,854,085 | B1 * | 12/2010 | Hodgkins et al. | 42/85 |
| 7,942,090 | B1 * | 5/2011 | Hoffman | 89/29 |
| 8,091,462 | B2 * | 1/2012 | Dueck et al. | 89/14.05 |
| 8,201,487 | B2 * | 6/2012 | Dueck et al. | 89/14.05 |
| 2004/0155462 | A1 * | 8/2004 | Nguyen et al. | 285/321 |
| 2012/0153615 | A1 * | 6/2012 | Rehder et al. | 285/399 |

* cited by examiner

*Primary Examiner* — Samir Abdosh
(74) *Attorney, Agent, or Firm* — James R. Eley; Michael A. Forhan; Eley Law Firm Co., LPA

(57) ABSTRACT

A locking device mountable to a rifle flash hider having grooved and flat portions. The locking device includes a body portion having an end, a bore and at least two undercut slots located in the end. At least two locking tabs are slidably engaged in the undercut slots, the locking tabs having a mounting hole and flat and arcuate confronting surfaces. An endcap is engageable with the body, the endcap having a central opening and at least two eccentric slots. At least two guide pins are located within the eccentric slots and engaged with the corresponding locking tab mounting holes. The locking tabs slidably move within the undercut slots in the body towards and away from the endcap opening when the endcap is rotated, thereby engaging and disengaging a flash hider having corresponding flat and arcuate portions.

8 Claims, 2 Drawing Sheets

QUICK-ATTACH LOCKING DEVICE FOR A FLASH HIDER

This application claims priority to U.S. Provisional Patent Application No. 61/312,516, filed Mar. 10, 2010, the contents of which are hereby incorporated by reference.

FIELD

The present invention relates generally to firearms, more specifically to a device for securing auxiliary attachments, such as a sound suppressor, to the end of a gun barrel having a flash hider.

BACKGROUND

Various devices are attachable to firearms for the purpose of reducing the sound and flash emitted during firing. For example, flash hiders attached to the end of a rifle barrel tend to constrict the path of escaping, burning gasses, thereby reducing the field of view from which the muzzle flash is readily visible. Similarly, sound suppressors function by diverting the path of the escaping gasses in such as way as to temporally disperse the escape of burnt and/or burning gasses from the barrel. This has the effect of dispersing over time what otherwise would be a loud "muzzle blast," in order to provide a quieter report.

Some models of firearms, such as the AR-15, M-16 and M-4 rifles (hereinafter sometimes referred to as "AR" type rifles), are provided with a Mil-spec "A2" or "birdcage" type flash hider having a standard size and shape threaded onto the end of the barrel. Various aftermarket alternatives to the A2 exist, such as those made available through Primary Weapons Systems, as its model PWS 102-2T. However, should a user wish to use a suppressor in connection with a rifle having an A2 flash hider, then the suppressor would typically require removal of the threaded flash hider to install a threaded suppressor in its place at the end of the rifle barrel.

Depending upon the task or mission, a user may need to quickly alternate between the use of a suppressor and a flash hider on an AR rifle. In a tactical situation, unthreading and threading these accessories is cumbersome, time consuming and potentially life threatening.

In some instances attempts to overcome this has included replacing the standard A2 flash hider with a proprietary flash hider that is designed to interface with a mating, proprietary suppressor design. Unfortunately, there is no industry accepted standard for such flash hider and detachable suppressor arrangements. Consequently, users having an inventory of firearms, such as law enforcement and military personnel, would necessarily accumulate a number of firearms with a collection of various types of proprietary flash hiders and suppressors that may be incompatible with one another. This limits an armorer's ability to reconfigure their weaponry for changing tactical needs by mixing and matching weapons and attachments. Similarly, the use of such proprietary arrangements limits the ability of armorers to assemble serviceable equipment from their component inventories.

It should also be noted that precision alignment and clearances of the internal dimensions of the attachments with respect to the rifle barrel are necessary for safe and proper use. There is a need for a way to safely and reliably couple attachments to the Mil-spec A2 flash hider and its alternatives, obviating the need for the aforementioned proprietary arrangements.

SUMMARY

A quick-attach locking device for mounting accessories, such as a suppressor, to a weapon fitted with an A2 flash hider is disclosed according to an embodiment of the present invention. The quick-attach locking device enables accessories to be mounted over and to a fixed A2 flash hider without first requiring its removal. Although it is anticipated to be utilized primarily in connection with a sound suppressor, it is clear that the arrangement described herein is adaptable for mounting any suitable device to the end of a weapon fitted with an A2 flash hider.

The locking device comprises a cylindrically-shaped body having a bore and a pair of undercut slots. The locking device also includes a cylindrically-shaped, hollowed, rotatable endcap having a pair of eccentrically offset curved slots, as well as a pair of slidable locking tabs. A portion of each locking tab is slidably inserted into each of the undercut slots of the body. The endcap is coupled to the body such that it fits inside a hollow interior of the endcap, a mating surface of the body being facially adjacent to a closed end of the endcap. A guide pin is inserted through each curved slot of the endcap to engage a corresponding threaded opening of a locking tab. A biasing means, such as at least one spring loaded plunger, urges the endcap away from the body, thereby applying pressure between the face of the endcap and the underside of the heads of the guide pins. Rotating the endcap causes the curved slots to move slidably with respect to the guide pins between the two extremes of the slots. The curved slots have an eccentric relationship to a rotational centerline of the locking device, causing the locking tabs to be slidably urged along the undercut slots to engage or disengage a mounted A2 flash hider, depending upon the direction of rotation. Recessed apertures may be provided along or at the end of the slots to receive the heads of the guide pins as the endcap is rotated. In this regard, the biased endcap may be locked into position as it is rotated fully into an engaged position with the A2 flash hider.

In another embodiment of the locking device which interfaces with the PWS type flash hiders, modifications are made to the locking tabs within the locking device to accommodate the differing profiles of the alternative flash hiders. Accordingly, while this disclosure focuses primarily on the A2 style flash hider, the disclosed invention also includes locking devices for other styles of flash hiders within the scope of the invention.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION

Figures 1, 2, 3, 4:
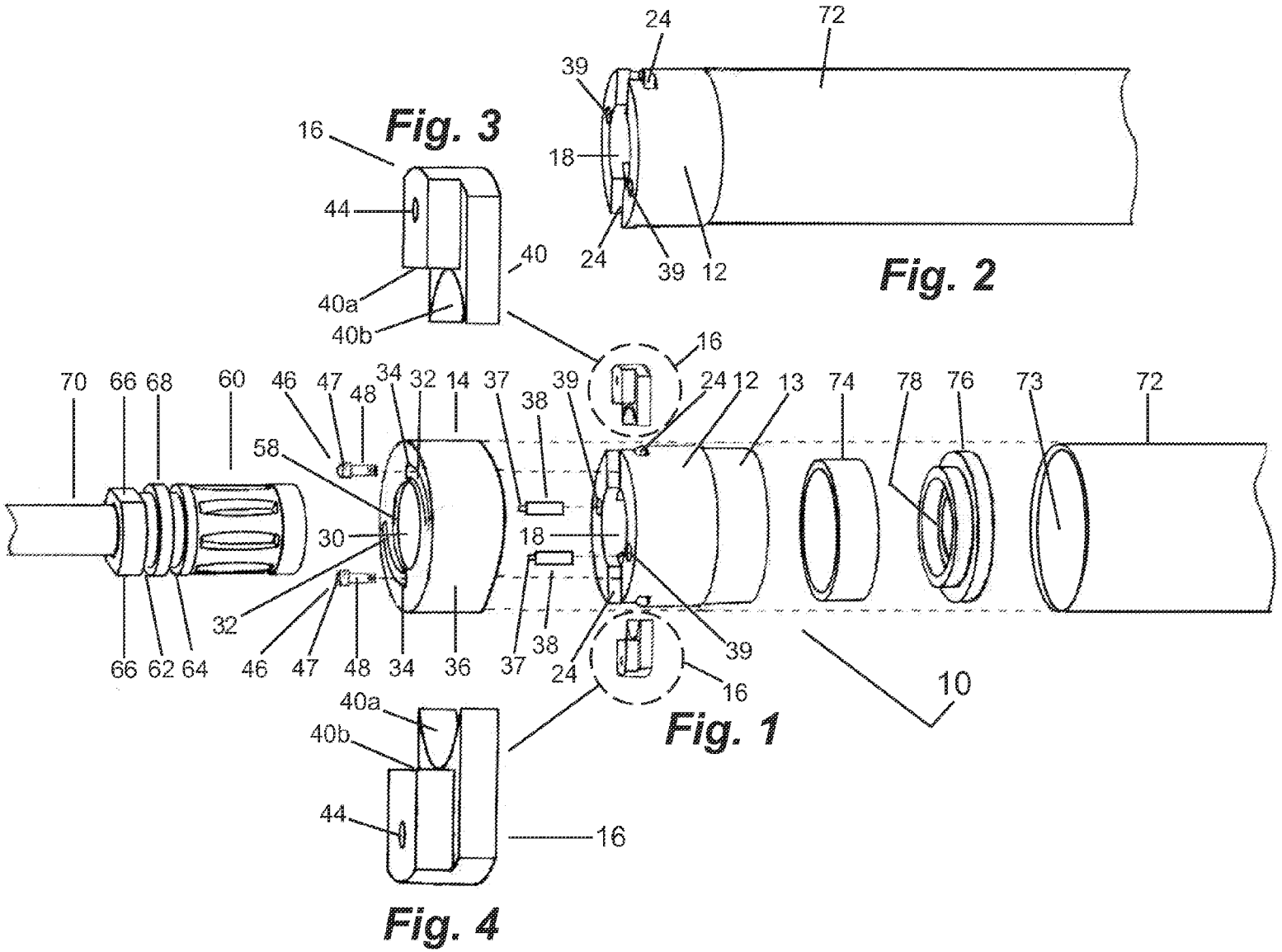
FIG. 1 is a exploded perspective side view of a flash hider locking device according to an embodiment of the present invention.
FIG. 2 is a perspective elevation view of the body of the locking device of according to the present invention shown engaged with a suppressor tube.
FIG. 3 is an enlarged view of one of the locking tabs according to an embodiment of the invention.
FIG. 4 is an enlarged view of a second one of the locking tabs according to an embodiment of the invention.

The general arrangement of a quick attach locking device 10 for an A2 type flash hider is shown in FIG. 1 according to an embodiment of the present invention. Locking device 10 comprises a cylindrically-shaped body 12, having a bore corresponding to the diameter of a flash hider, a cylindrically-shaped, hollowed rotatable endcap 14, a pair of slidable locking tabs 16, a pair of guide pins 46 engaging eccentric slots 32 and biasing means, such as spring loaded plungers 38. One such type of plunger 38 is available in threaded form to mount in corresponding threaded holes 39 and sold as a Model SSS50 From Vlier, Inc. However, it is understood that the biasing means can comprise any number of devices, such as a leaf spring, resilient coil or spring washer to accomplish a similar function.

With continued reference to FIGS. 1A and 1B in combination with FIGS. 2A through 2E, body 12 has a body opening 18. Body 12 further includes a mounting portion 13 sized and arranged to receive an attachment, such as a suppressor tube or "can" 72. In some embodiments receiver portion 13 may include fastening means including, without limitation, threads (not shown) to engage a mounting portion 73 of suppressor tube 72, or the can may be permanently bonded or attached to the receiver upon assembly. Body 12 also includes a pair of aligned slots 24, although a greater or lesser number of each is envisioned within the scope of the invention. Milled slots, not shown, may be provided in the interior surface of the body 12 or endcap 14 to facilitate removal of carbon build up from the surface of flash hider 60 as the locking device 10 is unlocked and disengages the flash hider.

Portions of locking device 10 may be fabricated from any number of suitable materials, such as, without limitation, titanium, steel and aluminum. Likewise, the portions of the locking device 10 may be finished in any number of ways, including anodizing, painting, milling or left in their respective unfinished states. Due to the expected duty of the locking device 10, it is expected that the materials and finishing selected with provide for rough handling and unfavorable environmental conditions.

Figure 5:
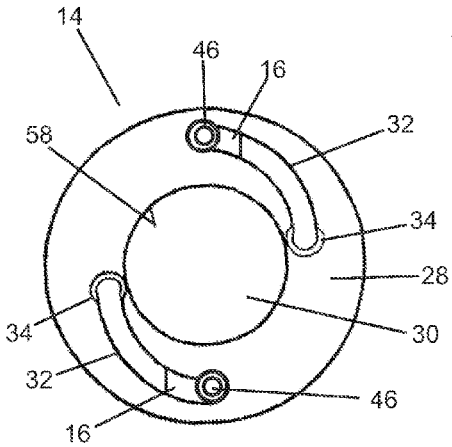
FIG. 5 is a top plan view of the endcap portion in a disengaged condition, with the locking tabs fully retracted, according to an embodiment of the present invention.
Figure 6:
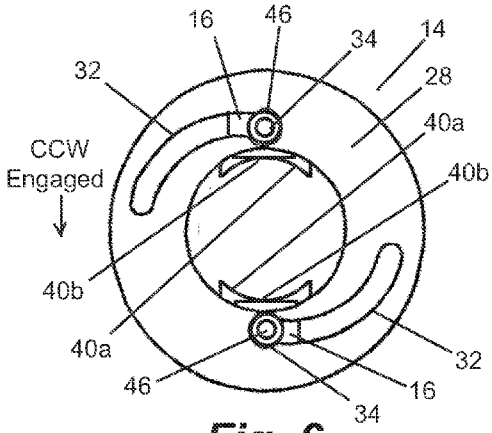
FIG. 6 is a top plan view of the endcap portion in a engaging condition, with the locking tabs fully extended toward the central opening of the endcap, according to an embodiment of the present invention.

Endcap 14 is shown in FIGS. 1, 5, and 6. Endcap 14 is generally cylindrical and hollow with a generally planar closed end 28 having an endcap opening 30, sized to accommodate the diameter of flash hider 60. Closed end 28 also includes a pair of curved slots 32 truncating in countersunk detents or recessed apertures 34 for retaining the heads of guide pins 46 when the device 10 is rotated into a locked condition. Biasing pins 38 urges endcap 14 away from body 12, thereby removably locking the endcap in the locked position to secure it to flash hider 60 until it is desired to remove it. In some embodiments an exterior sidewall 36 of endcap 14 may have a knurled or otherwise textured surface (not shown) for purposes of gripping and rotating the endcap between disengaged and engaged conditions.

Figure 7:
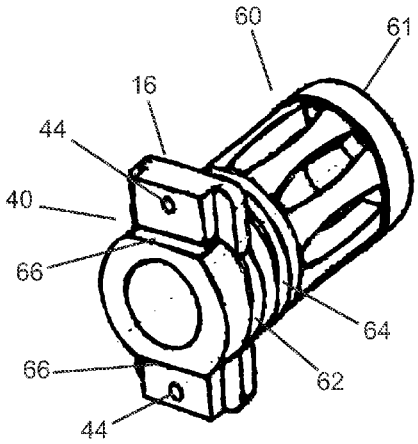
FIG. 7 is a schematic view depicting two locking tabs engaged with corresponding portions of an A2 flash hider when in the condition depicted in FIG. 6, according to an embodiment of the present invention.

Details of locking tab 16 are shown in FIGS. 3, 4 and 7. Locking tab 16 is sized and shaped to move slidably within corresponding slots 24 of body 12 (FIGS. 1 and 2). In one embodiment locking tabs 16 include a pair of ears 40 that are sized and shaped to be received by an undercut portion 42 of slots 24. Locking tab 16 may also have a threaded opening 44 arranged to receive a threaded member, such as guide pin 46. For the A2 type flash hider 60, each ear 40 may be fashioned with a curved portion 40*a* and a flat portion 40*b* for engaging a corresponding first groove 62 and a flats 66 of flash hider. As can be seen in the figures, groove 62 is circumferential and is formed between the flats 40*b* and a ring 68 of flash hider 60. In the alternative, that is, to engage a PWS 102-2T type flash hider 60, each ear 40 may be fabricated in a different profile, such as the curved portion having a radius corresponding to the physical dimensions of that model and yet preferably corresponding to the profile of the flash hider 60 when device 10 is in the closed and locked condition. In the case of attaching the locking device 10 to flash hider 60, the flat portions 40*b* of the locking ears 40 engage the flats 66*b* of the flash hider and the curved portion 40*a* compressingly engage an outer surface of the flash hider when endcap 14 is rotated CW into its locked condition.

With reference now to FIG. 1, locking device 10 is assembled by installing a locking tab 16 slidably into each of slots 24 of body 12. Biasing pins 38 are installed in their corresponding holes 39 in the face of body 12. Endcap 14 is then coupled to body 12 such that the body fits inside the hollow interior of the endcap and facially adjacent to the inside face (not shown) of the endcap. A guide pin 46 is inserted through each of curved slots 32 of endcap 14 to engage a corresponding threaded opening 44 of each of locking tabs 16 and then tightened to a predetermined degree that permits the endcap to remain easily rotatable. In the assembled condition when the endcap 14 is rotated clockwise ("CW") into its "locked" position, a head portion 47 of each guide pin 46 is urged into a corresponding endcap aperture 34 or detent and is retained therein by the outward pressure applied to the endcap by the biasing pins 38 until released by compressing and then rotating the endcap counter-clockwise ("CCW").

With reference to FIGS. 1, 5, 6 and 8, to install locking device 10 onto a flash hider 60 a user begins in the condition represented in FIG. 5, and inserts a flash hider into endcap opening 30 and body opening (bore) 18 until a muzzle 61 of flash hider 60 bottoms out against the inside face 78 of first baffle portion 76 of a suppressor. One the flash hider 60 is fully inserted into an open endcap 14, a user grasps the surface 36 of the endcap and then rotates the endcap CCW with respect to body 12 (FIG. 6). Rotating endcap 14 in this manner causes curved slots 32 to move slidably with respect to guide pins 46. Because curved slots 32 have an eccentric orientation with respect to a rotational centerline of locking device 10, rotating the endcap 14 in this manner causes locking tabs 16 to be slidably urged along corresponding slots 24 and toward the center of endcap and body openings 18, 30 respectively. At this point, curved and flat portions 40*a* and 40*b* of locking tabs 16 are preferably and simultaneously aligned with a groove 62 and flats 66 of flash hider 60.

With continued reference to FIGS. 1 and 5, to detach quick-attach locking device 10 from flash hider 60, the user grasps the outer surface 36 of endcap 14 and compresses it while simultaneously rotating it clockwise (FIG. 5) with respect to body 12. Rotating endcap 14 in this manner causes curved slots 32 to move slidably with respect to guide pins 46 and urges the heads of the guide pins from each of their respective detents 34. Because curved slots 32 have an eccentric orientation with respect to rotational centerline of locking device 10, rotating the endcap 14 in this manner causes locking tabs 16 and their respective engaging portions 40*a* and 40*b* to be slidably urged along corresponding slots 24 and away from groove 62 and flats 66 of flash hider 60, out of the aligned body and endcap openings 18, 30 respectively. The user may then slide locking device 10 away from the flash hider 60, thereby detaching the locking device from the flash hider.

Figure 8:
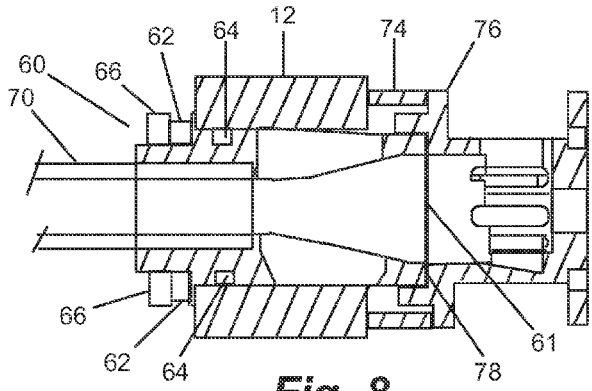
FIG. 8. is a longitudinal section view of an A2 flash hider engaging the body portion of the locking device and a first baffle portion of a sound suppressor, according to an embodiment of the present invention.

FIG. 8 is a sectional view of the body 12 of a quick-attach locking device shown engaged with a portion of a first baffle 76 of a sound suppressor according to a non- limiting example embodiment of the present invention.

From the above description of the invention, those skilled in the art will perceive improvements, changes, and modifications in the invention. Such improvements, changes, and modifications within the skill of the art are intended to be covered.

I claim:

1. A locking device mountable to a rifle flash hider having grooved and flat portions, said device comprising:

a body portion having an end, a bore and at least two undercut slots located in the end;

at least two locking tabs, slidably engaged in said undercut slots, said locking tabs having a mounting hole and flat and arcuate confronting surfaces;

an endcap engageable with said body, said endcap having a central opening and at least two eccentric slots; and at least two guide pins located within the eccentric slots and engaged with the corresponding locking tab mounting holes, whereby the locking tabs slidably move within the undercut slots in the body towards and away from the endcap opening when the endcap is rotated, thereby engaging and disengaging a flash hider having corresponding flat and arcuate portions.

2. The locking device of claim 1 comprising recessed apertures located within the eccentric slots.

3. The locking device of claim 1 including a biasing means to urge the endcap away from the body.

4. The locking device of claim 3 wherein the biasing means comprises spring loaded plungers.

5. The locking device of claim 3 wherein the biasing means comprises a spring washer.

6. The locking device of claim 2 wherein each recessed aperture is sized to correspond to the diameter of a head of a guide pin for locking the endcap in an engaged condition when the head is aligned with said recessed aperture.

7. The locking device of claim 6 further comprising a biasing means for urging the endcap away from the body thereby captively retaining each head of each guide pin within their corresponding recessed aperture when in alignment.

8. The locking device of claim 1 wherein the locking tabs comprise arcuate and flat confronting surfaces having a physical profile corresponding to the physical profile of an A2 style flash hider.

* * * * *